US010515738B2

(12) United States Patent
Uegaki et al.

(10) Patent No.: US 10,515,738 B2
(45) Date of Patent: Dec. 24, 2019

(54) COPPER ALLOY WIRE, COPPER ALLOY TWISTED WIRE, COVERED ELECTRIC WIRE, AND WIRING HARNESS

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Ryoma Uegaki, Mie (JP); Akiko Inoue, Osaka (JP); Tetsuya Kuwabara, Osaka (JP); Hiroyuki Kobayashi, Mie (JP); Kinji Taguchi, Mie (JP); Yasuyuki Ootsuka, Mie (JP)

(73) Assignees: SUMITOMO WIRING SYSTEMS, LTD., Yokkaichi, Mie (JP); AUTONETWORKS TECHNOLOGIES, LTD., Yokkaichi, Mie (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 15/566,808

(22) PCT Filed: Apr. 7, 2016

(86) PCT No.: PCT/JP2016/061389
§ 371 (c)(1),
(2) Date: Oct. 16, 2017

(87) PCT Pub. No.: WO2016/170992
PCT Pub. Date: Oct. 27, 2016

(65) Prior Publication Data

US 2018/0102199 A1 Apr. 12, 2018

(30) Foreign Application Priority Data

Apr. 21, 2015 (JP) ..... 2015-086943

(51) Int. Cl.
*H01B 1/00* (2006.01)
*H01B 5/02* (2006.01)
*H01B 5/08* (2006.01)

(52) U.S. Cl.
CPC ..... *H01B 5/02* (2013.01); *H01B 5/08* (2013.01)

(58) Field of Classification Search
CPC ..... H01B 1/026
(Continued)

(56) References Cited

U.S. PATENT DOCUMENTS 4,559,200 A * 12/1985 Yamasaki ..... C22C 9/00 420/473
2004/0234412 A1 11/2004 Oishi
(Continued)

FOREIGN PATENT DOCUMENTS

JP 2005336579 A 12/2005
JP 2006291271 A 10/2006
(Continued)

OTHER PUBLICATIONS

International Search Report for Application No. PCT/JP2016/061389 dated Jul. 5, 2016; 6 pages.
(Continued)

*Primary Examiner* — Chau N Nguyen
(74) *Attorney, Agent, or Firm* — Reising Ethington, P.C.

(57) ABSTRACT

A copper alloy wire, a copper alloy twisted wire, a covered electric wire, and a wiring harness that have high strength and excellent impact resistance. A copper alloy wire for use as a conductor has a ratio of 0.2% proof stress to tensile
(Continued)

strength that is 0.87 or less. A copper alloy twisted wire includes a plurality of the twisted copper alloy wires. A covered electric wire includes a conductor including the copper alloy wire and an insulation cover that covers an outer periphery of the conductor. A wiring harness includes the covered electric wire, and a terminal metal fitting that is attached to the conductor of the covered electric wire.

11 Claims, 2 Drawing Sheets

(58) Field of Classification Search
USPC ..... 174/126.1, 94 R
See application file for complete search history.

(56) References Cited

U.S. PATENT DOCUMENTS

| | | | | |
|---|---|---|---|---|
| 2008/0011396 | A1* | 1/2008 | Kaneko | C22C 9/02 148/684 |
| 2012/0018192 | A1 | 1/2012 | Takahashi et al. | |
| 2013/0092437 | A1* | 4/2013 | Yoshinaga | C22C 9/00 174/75 R |
| 2015/0371726 | A1 | 12/2015 | Inoue et al. | |

FOREIGN PATENT DOCUMENTS

| | | | |
|---|---|---|---|
| JP | 2008016284 | A | 1/2008 |
| JP | 2009242884 | A | 10/2009 |
| JP | WO2009154239 | A | 12/2009 |
| JP | WO2010084989 | A | 7/2010 |
| WO | WO2014125677 | A | 8/2014 |

OTHER PUBLICATIONS

Chinese Office Action for Application No. 201680021662.4 dated Sep. 5, 2018; 8 pages.

English Translation for Chinese Office Action for Application No. 201680021662.4 dated Sep. 5, 2018; 10 pages.

Chinese Office Action Issued by China National Intellectual Property Administration for CN 201680021662.4 dated May 7, 2019.

Translation of Chinese Office Action Issued by China National Intellectual Property Administration for CN 201680021662.4 dated May 7, 2019.

* cited by examiner

COPPER ALLOY WIRE, COPPER ALLOY TWISTED WIRE, COVERED ELECTRIC WIRE, AND WIRING HARNESS

CROSS REFERENCE TO RELATED APPLICATIONS

This application claims the priority of Japanese patent application JP2015-086943 filed on Apr. 21, 2015, the entire contents of which are incorporated herein.

TECHNICAL FIELD

The present invention relates to copper alloy wires and copper alloy twisted wires suitable as conductors of electric wires, and to covered electric wires and wiring harnesses using the same as their conductors.

BACKGROUND ART

In the automotive field, electric wires have been increasingly reduced in diameter. Electric wires reduced in diameter have a reduced conductor cross-sectional area, resulting in reduced strength. In order to solve this problem, it has been proposed to use, as conductors of electric wires such as electric wires for automobile, copper alloy wires for the purpose of high strengthening.

JP2008-16284 is an example of related art.

SUMMARY

When a hard copper alloy material is used as conductors of electric wires in order to improve the strength, the conductors have insufficient toughness and are weak to impact force, and could be easily broken, for example, when a load is drastically applied thereto in a short time.

The present alloy has been made to solve the above problems, and an object thereof is to provide a copper alloy wire, a copper alloy twisted wire, a covered electric wire, and a wiring harness that have high strength and excellent impact resistance.

To achieve the objects and in accordance with the purpose of the present application, a copper alloy wire for use as a conductor has a ratio of 0.2% proof stress to tensile strength that is 0.87 or less.

It is preferable that the copper alloy wire should have a tensile strength of 450 MPa or more. In addition, it is preferable that the copper alloy wire should have a total elongation of 8% or more.

A copper alloy twisted wire includes a plurality of the twisted copper alloy wires according to the present alloy.

It is preferable that the copper alloy twisted wire should be compression molded in a radial direction. In addition, it is preferable that the copper alloy twisted wire should have a cross-sectional area of 0.22 $mm^2$ or less.

A covered electric wire according to the present application includes a conductor including the copper alloy wire according to the present application, and an insulation cover that covers an outer periphery of the conductor.

A wiring harness according to the present application includes the covered electric wire according to the present application, and a terminal metal fitting that is attached to the conductor of the covered electric wire.

With the copper alloy wire according to the present application, reducing the proof stress with respect to the tensile strength improves the metallic toughness in the copper alloy that is excellent in strength, and thus the copper alloy wire can have high strength and excellent impact resistance.

With the copper alloy twisted wire, the covered electric wire, and the wiring harness according to the present application, reducing the proof stress of the copper alloy wire with respect to the tensile strength improves the metallic toughness in the copper alloy that is excellent in strength, and thus the copper alloy twisted wire, the covered electric wire, and the wiring harness can have high strength and excellent impact resistance.

DESCRIPTION OF EMBODIMENTS

Figure 1A:
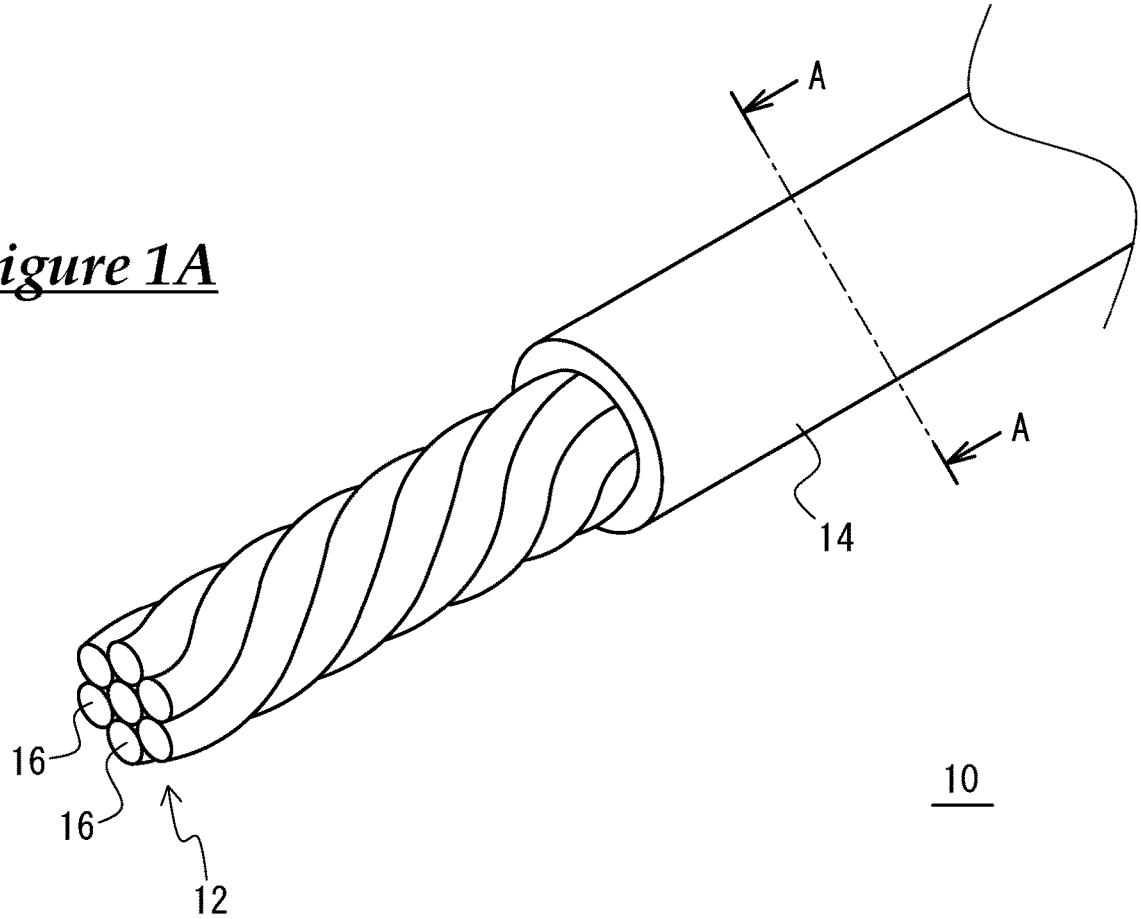
FIG. 1A is a schematic view of a covered electric wire according to one embodiment.

Next, detailed descriptions of embodiments of the present application will be provided.

A copper alloy wire for use as a conductor according to the present application has a ratio of 0.2% proof stress to tensile strength that is 0.87 or less. Reducing the proof stress with respect to the tensile strength improves the metallic toughness in the copper alloy that is excellent in strength, and thus the copper alloy wire has high strength and excellent impact resistance. The ratio of 0.2% proof stress to tensile strength is preferably 0.85 or less. The ratio of 0.2% proof stress to tensile strength can be made to fall within a specific range depending on the kinds and the additive amounts of additive elements, the degree of wire drawing, and the temperature and the time of heat treatment.

When a hard material is used for the copper alloy wire, the metallic toughness disappears to reduce the impact resistance. For this reason, precipitation strengthening is preferred as a strengthening mechanism for the copper alloy wire because both strength and elongation can be achieved while the copper alloy wire has a high electrical conductivity. Examples of precipitates include $Fe_2Ti$ precipitates, which are compounds of Fe and Ti. Examples of this copper alloy include a copper alloy that contains Fe, Ti, and the balance Cu with impurities.

Fe contributes to improvement of strength by being dissolved or precipitated in Cu. The content of Fe is preferably 0.4 mass % or more, more preferably 0.45 mass % or more, and still more preferably 0.5 mass % or more from the viewpoint of improving the strength. On the other hand, the content of Fe is preferably 1.5 mass % or less, more preferably 1.3 mass % or less, and still more preferably 1.1 mass % or less from the viewpoint of suppressing deterioration of wire drawability and electrical conductivity caused by addition of Fe.

Ti contributes to improvement of electrical conductivity and strength by being present with Fe. The content of Ti is preferably 0.1 mass % or more, and more preferably 0.15 mass % or more from the viewpoint of improving the strength. On the other hand, the content of Ti is preferably 1.0 mass % or less, more preferably 0.7 mass % or less, and still more preferably 0.5 mass % or less from the viewpoint of suppressing deterioration of wire drawability and electrical conductivity caused by addition of Ti.

In a copper alloy, $Fe_2Ti$ precipitates contribute to improvement of strength. The number of $Fe_2Ti$ precipitates having a circle equivalent diameter of 10 nm to 90 nm is preferably 10 or more, and more preferably 15 or more in an observation visual field of 700×850 nm. Thus, the strength can be improved while the ratio of 0.2% proof stress to tensile strength is kept low, so that even a small-diameter electric wire having a conductor cross-sectional area of 0.22 $mm^2$ or less can obtain crimping strength to a terminal required of electric wires for automobile. The amount of $Fe_2Ti$ precipitates can be made to fall within a specific range depending on the additive amounts of additive elements, and manufacturing conditions (e.g., the temperature of heat treatment).

A copper alloy preferably has a dislocation density in the range of $1\times10^6$ to $1\times10^8$ $cm^{-2}$. Since the dislocation density contributes to improvement of strength, a copper alloy wire of high strength can be obtained; however, when the dislocation density is high, the elongation is reduced while the ratio of 0.2% proof stress to tensile strength becomes high, and the impact resistance tends to be reduced. The dislocation density can be lowered through heat treatment. The dislocation density can be calculated using the equation of Ham by observing a thin film prepared from a copper alloy wire under a transmission electron microscope (TEM).

The copper alloy wire according to the present application has high strength, and preferably has a tensile strength that satisfies 450 MPa or more. Having a tensile strength of 450 MPa or more, even the small-diameter electric wire having a conductor cross-sectional area of 0.22 $mm^2$ or less has a crimping strength to a terminal of 50 N or more, and thus has strength so as to be applicable to an electric wire for automobile. The tensile strength can be made to fall within a specific range depending on the kinds and the additive amounts of additive elements, manufacturing conditions (the degree of wire drawing, and the temperature of heat treatment), and the like. It is preferable for the copper alloy wire to have a higher tensile strength; however, the upper limit of the tensile strength is about 650 MPa from the viewpoint of the balance between tensile strength and elongation.

The copper alloy wire has excellent elongation, and preferably has a total elongation that satisfies 8% or more. The elongation can be made to fall within a specific range by subjecting the copper alloy wire to given heat treatment after wire drawing. It is preferable for the copper alloy wire to have a higher elongation since more excellent impact resistance can be achieved; however, the upper limit of the elongation is about 20% from the viewpoint of the balance between elongation and strength.

The copper alloy wire is excellent in electrical conductivity, and preferably has an electrical conductivity that satisfies 60% IACS or more. The electrical conductivity can be made to fall within a specific range depending on the kinds and the additive amounts of additive elements, manufacturing conditions (the degree of wire drawing, and the temperature and the time of heat treatment), and the like. It is preferable for the copper alloy wire to have a higher electrical conductivity; however, the upper limit of the electrical conductivity is about 80% IACS from the viewpoint of limitation of increase in electrical conductivity due to precipitation of the additive elements.

The tensile strength and the elongation can be measured in accordance with the JIS Z 2241 (a method of tensile test for metallic materials, 1998) with the use of a common tensile tester. The values of the tensile strength and the elongation define measured values at room temperature. The elongation defines breaking elongation. The electrical conductivity (% IACS) can be measured by a bridge method.

The copper alloy wire is excellent in strength and impact resistance, and can be made as an extra fine wire having a diameter of 0.5 mm or smaller. For example, when used for a conductor of an electric wire for automobile, the copper alloy wire may have a diameter of 0.1 mm to 0.4 mm.

The copper alloy wire may be a twisted wire made by twisting a plurality of wires (the copper alloy twisted wire according to the present invention). The copper alloy wire in the form of a twisted wire like this is more excellent in flexibility. In addition, while flexibility is kept increased in the copper alloy wire, strength and impact properties can be ensured. In addition, even when the copper alloy wire is made as an extra fine wire having a diameter of 0.5 mm or smaller, strength and impact properties can be ensured. The number of the twisted wires is, but not particularly limited to, 7, 11, 19, 37, 49, and 133, for example.

The copper alloy twisted wire consists of elemental wires of copper alloy wires that are excellent in strength and impact resistance, and may be a small-diameter electric wire having a conductor cross-sectional area of 0.22 $mm^2$ or less. Even the small-diameter electric wire having a conductor cross-sectional area of 0.22 $mm^2$ or less can obtain crimping strength to a terminal required of electric wires for automobile.

The copper alloy twisted wire may be compression molded in the radial direction (circularly compression molded). Thus, the gaps among the copper alloy wires can be reduced, and accordingly the wire diameter of the entire twisted wire can be reduced, which can contribute to reduction of the wire diameter of the conductor.

Figure 1B:
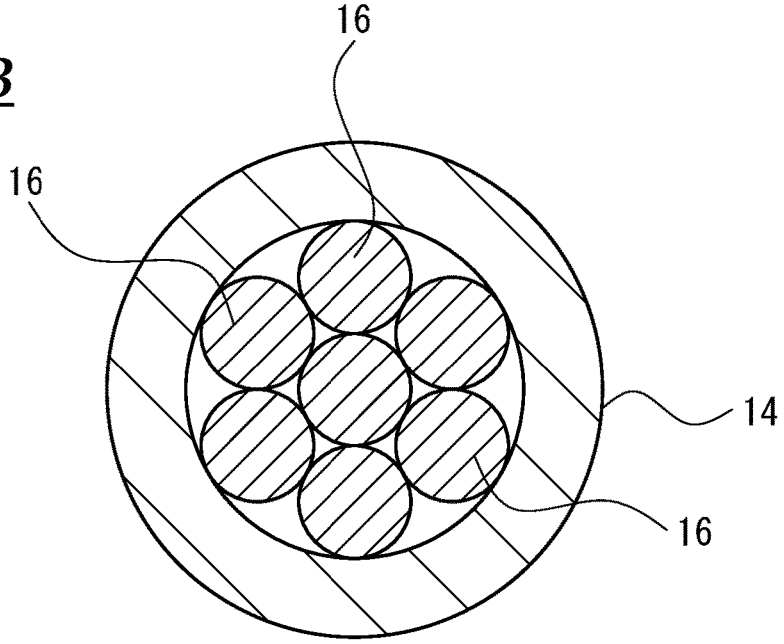
FIG. 1B is a cross-sectional view of the same taken along the line A-A of FIG. 1A.
Figure 2:
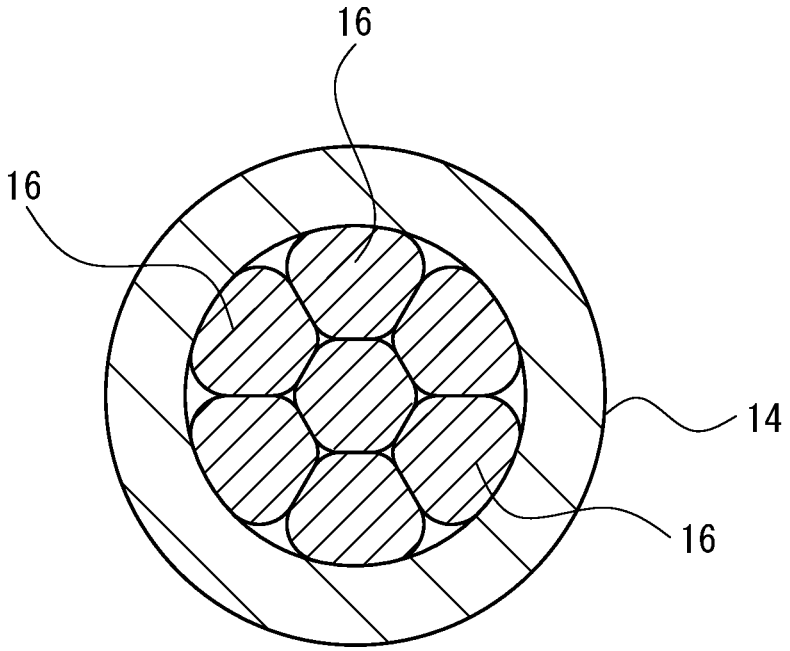
FIG. 2 is a cross-sectional view of the covered electric wire in which a copper alloy twisted wire (conductor) illustrated in FIG. 1B is compression molded.

FIG. 1A is a perspective view of a copper alloy twisted wire according to one embodiment, and FIG. 1B is a cross-sectional view of the same taken along the line A-A of FIG. 1A. FIG. 2 is a cross-sectional view of the copper alloy twisted wire in which the conductor illustrated in FIG. 1B is compression molded.

As illustrated in FIG. 1, a copper alloy twisted wire 12 is made by twisting a plurality of copper alloy wires 16 (seven wires in FIG. 1). As shown in FIG. 2, the copper alloy twisted wire 12 may be compression molded in the radial direction (circularly compression molded).

One copper alloy wire according to the present application can constitute a conductor of an electric wire. Alternatively, two or more copper alloy wires according to the present application can constitute a conductor of an electric wire. Alternatively, in combination with another metallic electric wire, the copper alloy wire according to the present application can constitute a conductor of an electric wire. Alternatively, the copper alloy twisted wire according to the present application that includes the copper alloy wire according to the present application can constitute a conductor of an electric wire. As described above, a conductor including the copper alloy wire according to the present application can constitute a conductor of an electric wire. The covered electric wire according to the present application can be obtained by covering the outer periphery of the conductor including the copper alloy wire according to the present application.

In the covered electric wire, examples of an insulation material for the insulation cover include, but not particularly limited to, a vinyl chloride resin (PVC) and an olefin resin. A flame retardant such as magnesium hydroxide and a brominated flame retardant may be contained in the insulation material.

FIG. 1A is a perspective view of a covered electric wire according to one embodiment, and FIG. 1B is a cross-sectional view of the same taken along the line A-A of FIG. 1A. FIG. 2 is a cross-sectional view of the covered electric wire in which the conductor illustrated in FIG. 1B is compression molded.

As illustrated in FIGS. 1 and 2, a covered electric wire 10 according to one embodiment includes the conductor consisting of the copper alloy twisted wire 12, and an insulation cover 14 that covers the outer periphery of the conductor.

A wiring harness according to the present application can be produced by connecting the conductor of the covered electric wire according to the present application with a terminal metal fitting. The terminal metal fitting is attached to a conductor terminal. The terminal metal fitting is connected with the conductor by a variety of connection methods such as crimping and welding. The terminal metal fitting is connected with a counterpart terminal metal fitting.

The copper alloy wire according to the present application can be made, for example, of a copper alloy material through a solution step, a wire drawing step, a heat treatment step, or the like.

The copper alloy material can be obtained by subjecting a molten alloy having predetermined composition to casting and plastic processing. As the casting, continuous casting can be suitably used. A supersaturated solid solution in which additive elements are sufficiently dissolved in Cu may be formed as a casing material through rapid cooling in the continuous casting step. The cooling rate during the casting, which can be appropriately selected, is preferably 5 degrees C./sec or more. For example, with a continuous casting apparatus having a water-cooled copper mold, a forced water cooling mechanism, or the like, rapid cooling at the cooing rate as described above can be easily carried out. Examples of the continuous casting include continuous casting using a movable mold such as a belt-and-wheel method or the like, and continuous casting using a frame-shaped fixed mold. The casting material obtained by the continuous casting is subjected to plastic processing such as swaging processing and rolling processing subsequent to the casting. The plastic processing is preferably carried out at the processing temperature of 150 degrees C. or less at the degree of processing of 50% to 90%.

In the solution step, the copper alloy material obtained through the casting/plastic processing is subjected to solution treatment. In the solution treatment, the copper alloy material is heated to the solid solution limit temperature or higher to sufficiently dissolve the alloy component (solid solution elements, precipitation strengthening elements), and is then cooled to be brought into a supersaturated solid solution state. The solution treatment is carried out at a temperature at which the alloy component can be sufficiently dissolved. The temperature of the solution treatment is preferably 850 degrees C. or more. The temperature of the solution treatment is preferably 950 degrees C. or less. The retention time is preferably five minutes or more so that the alloy component can be sufficiently dissolved. The retention time is preferably three hours or less from the viewpoint of productivity.

As a cooling process after the heating process of the solution treatment, a rapid cooling process is preferred. By rapidly cooling the material, excessive precipitation of dissolved elements can be prevented. The cooling rate is preferably 10 degrees C./sec or more. The rapid cooling can be carried out by forced cooling, for example, by immersing the material in a liquid such as water, or cooling the material by wind.

The solution treatment may be carried out under either an air atmosphere or a non-oxidizing atmosphere. Examples of the non-oxidizing atmosphere include a vacuum atmosphere (reduced pressure atmosphere), an inert gas atmosphere using nitrogen or argon, a hydrogen-containing gas atmosphere, and a carbon dioxide gas-containing atmosphere.

The solution treatment may be carried out in either continuous treatment or batch treatment (non-continuous treatment). When the continuous treatment is used, it is easy to subject a long wire to heat treatment over the entire length under uniform conditions, which can reduce variations of the properties of the wire. A heating method may be, but not particularly limited to, an electric heating method, an induction heating method, or a heating method using a heating furnace. When the electric heating or the induction heating is used as the heating method, it is easy to carry out rapid heating/rapid cooling, and it is accordingly easy to carry out the solution treatment in a short period of time. When the induction heating, which is a non-contact manner, is used as the heating method, the copper alloy material can be prevented from being scratched.

In the wire drawing step, the copper alloy material is subjected to a wire drawing processing to form elemental wires. The elemental wire defines a wire constituting a wire conductor, and constitutes a single wire or a twisted wire. The copper alloy material that has been subjected to the solution treatment is subjected to the wire drawing processing. That is, the wire drawing step defines a step to be carried out after the solution step. A desired number of the resulting drawn wires are twisted to form a stranded wire. The resulting drawn wires are wound around a drum usually in a single wire state, or in a twisted wire state, and are subjected to next treatment. If the wire drawing step is carried out before the solution step, the elemental wires are welded to each other in the solution step, which does not satisfy manufacturability.

In the heat treatment step, the copper alloy material is subjected to heat treatment. In the heat treatment, the alloy component (solid solution elements, precipitation strengthening elements) of the copper alloy that has been subjected to the solution treatment is heated to be precipitated as a compound. That is, the heat treatment step defines a step to be carried out after the solution step. The heat treatment step is preferably carried out after the wire drawing step from the viewpoint of easy wire drawing processing. By subjecting the copper alloy material to the heat treatment after the wire drawing processing, distortion created in the wire drawing processing may be removed during the heat treatment, leading to improvement in elongation.

In the heat treatment, the precipitate can be sufficiently precipitated at the heat treatment temperature of 350 degrees C. to 550 degrees C. for the retention time of 30 minutes or more. From the viewpoint of manufacturability, the retention time is preferably 40 hours or less. The precipitate can be more precipitated as the retention time of the heat treatment is longer. So, the conductivity may be improved when the retention time of the heat treatment is kept longer.

Example

Hereinafter, a description of an embodiment of the present application will be provided.

A master alloy containing electrolytic copper with a purity of 99.99% or more and additive elements was put into a high-purity carbon-made crucible, and vacuum molten in a continuous casting apparatus to produce a mixed molten metal. Each of the resulting mixed molten metals was continuously casted with the use of a high-purity carbon-made mold to produce a casting material having a circular cross section with a wire diameter of 12.5 mm. Each of the resulting casting materials was subjected to extrusion processing or rolled to 8 mm in diameter. Then, each of the casting materials was drawn to 0.165 mm or 0.215 mm in diameter, and seven wires of each of the casting materials were twisted/compressed with a pitch of 14 mm, and then were subjected to heat treatment.

The cross section of each of the produced copper alloy wires was observed under a transmission electron microscope (TEM), and the number of the precipitates and the dislocation density were evaluated for each of the produced copper alloy wires. The number of the precipitates having a size of 10 nm to 90 nm was counted in the observation visual field of 700×850 nm. The microgram of each precipitate was subjected to image processing to convert the area of each precipitate to a circle, and the diameter of the circle was defined as the size of each precipitate. As for the dislocation density, a metal thin film having a thickness of 0.15 μm was formed in an FIB method from each of the resulting copper alloy wires to be observed under a transmission electron microscope (TEM), and a spot where dislocations were most found was shot in the range of 700×850 nm. Ten vertical parallel lines and ten horizontal parallel lines were drawn on each photo, and let L represent the total length of the parallel lines, N represent the numbers of intersection points of the parallel lines and the dislocations, and t represent the thickness of a sample, and the dislocation density p was calculated by the expression: $\rho=2N/(L\times t)$. Each of the copper alloy wires was subjected to a tensile test with GL=250 mm at a tension rate of 50 mm/min in accordance with the JIS Z 2241 (a method of tensile test for metallic materials, 1998) with the use of a common tensile tester, and the tensile strength, the total elongation (the migration length between the chucks/GL), and the 0.2% proof stress of each of the copper alloy wires were measured.

Figure 3:
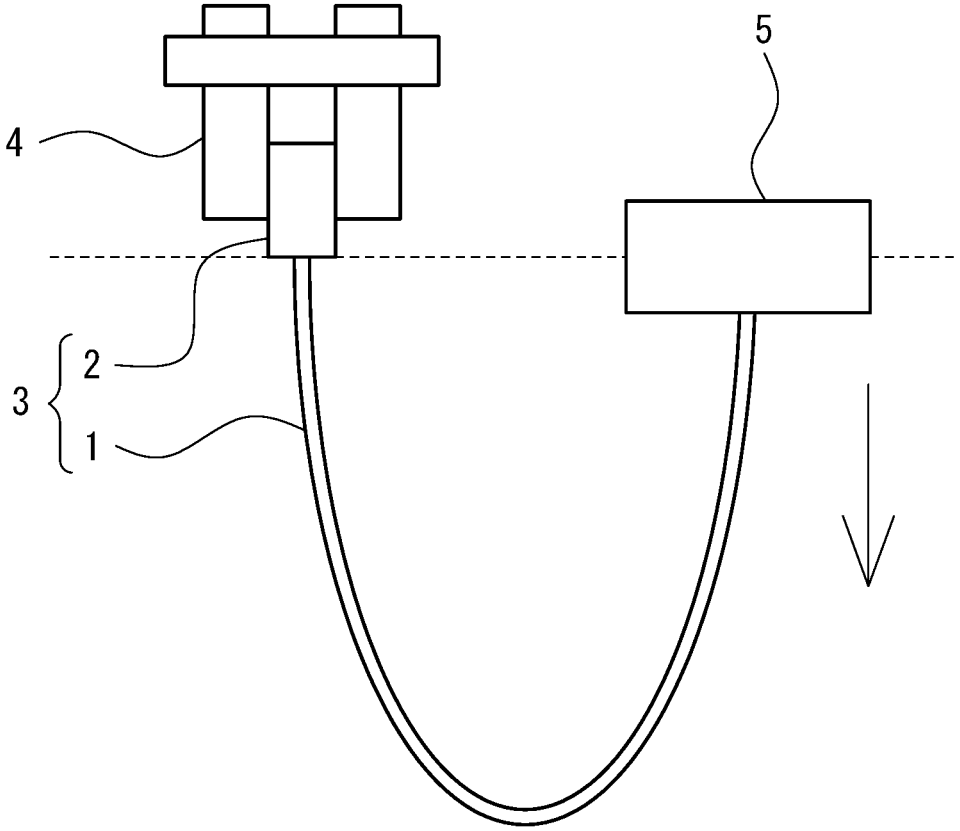
FIG. 3 is a schematic view of a test method for measuring impact strength when a terminal metal fitting is connected.

Then, a PVC insulation was extruded and each of the twisted wires was covered with the PVC insulation having a thickness of 0.2 mm, and then a terminal metal fitting was crimped onto one terminal of each of the twisted wires (C/H=0.76) to evaluate the crimping strength to each of the terminal metal fittings and the impact resistance at the portion of each of the twisted wires onto which the terminal metal fitting was crimped. The crimping strength to the terminal defined the maximum load that was obtained at the time when the conductor was broken when the wire portion was pulled at a tension rate of 50 mm/min with the terminal portion being secured to be held by the chucks. As for the impact resistance, as illustrated in FIG. 3, in each of the wiring harnesses 3 in which the terminal metal fitting 2 was crimped onto one end of the conductor (copper alloy twisted wire) of the covered electric wire 1 having a length of 500 mm, the terminal metal fitting 2 was secured to the jig 4 while the spindle 5 attached to the other end of the wiring harness 3 was pulled up to a fixed position and then freely dropped. The maximum energy (J) with which any breakage in the conductor (copper alloy twisted wire) of the covered electric wire 1 did not occur in this drop test at the portion of the wiring harness 3 onto which the terminal metal fitting 2 was crimped was defined as the impact resistant energy. Judgments whether or not the wiring harnesses were excellent in impact resistance were made with reference to the impact resistant energy (1.5 J) that was considered to have no practical problem in assembling an automotive harness.

TABLE 1

| | Composition (mass %) | | | Copper alloy wire | | Twisted wire | Heat treatment | |
|---|---|---|---|---|---|---|---|---|
| | | | | Wire diameter | Total elongation | Cross-sectional area of conductor | Temperature | Time |
| | Fe | Ti | Cu | (mm) | (%) | ($mm^2$) | (° C.) | (h) |
| Example 1 | 1.0 | 0.3 | Balance | 0.215 | 10 | 0.22 | 520 | 8 |
| Example 2 | 1.5 | 1.0 | Balance | 0.165 | 9 | 0.13 | 520 | 8 |
| Example 3 | 1.5 | 1.0 | Balance | 0.165 | 8 | 0.13 | 520 | 4 |
| Example 4 | 1.0 | 0.6 | Balance | 0.165 | 8 | 0.13 | 500 | 8 |
| Example 5 | 1.0 | 0.3 | Balance | 0.165 | 11 | 0.13 | 520 | 8 |
| Example 6 | 1.0 | 0.3 | Balance | 0.165 | 8 | 0.13 | 500 | 8 |
| Example 7 | 0.7 | 0.6 | Balance | 0.165 | 12 | 0.13 | 510 | 12 |
| Example 8 | 0.7 | 0.2 | Balance | 0.165 | 9 | 0.13 | 510 | 8 |
| Example 9 | 0.7 | 0.2 | Balance | 0.165 | 8 | 0.13 | 510 | 4 |
| Example 10 | 0.5 | 0.15 | Balance | 0.165 | 8 | 0.13 | 480 | 8 |
| Example 11 | 0.5 | 0.15 | Balance | 0.165 | 10 | 0.13 | 480 | 12 |
| Example 12 | 0.4 | 0.1 | Balance | 0.165 | 8 | 0.13 | 480 | 8 |
| Comparative example 1 | 1.0 | 0.6 | Balance | 0.215 | 7 | 0.22 | 460 | 8 |
| Comparative example 2 | 0.7 | 0.2 | Balance | 0.165 | 4 | 0.13 | 460 | 4 |
| Comparative example 3 | 0.7 | 0.2 | Balance | 0.165 | 7 | 0.13 | 460 | 8 |
| Comparative example 4 | 0.3 | 0.1 | Balance | 0.165 | 8 | 0.13 | 510 | 12 |
| Comparative example 5 | 0.3 | 0.1 | Balance | 0.165 | 6 | 0.13 | 480 | 12 |

TABLE 1-continued

| | Precipitate Number (Piece) | Dislocation Dislocation density ($cm^{-2}$) | Properties: Tensile strength (MPa) | 0.2% proof stress (MPa) | 0.2% proof stress Tensile strength | Crimping strength to a terminal (N) | Impact resistance (J) |
|---|---|---|---|---|---|---|---|
| Example 1 | 18 | $2 \times 10^6$ | 480 | 413 | 0.86 | 83 | 1.7 |
| Example 2 | 17 | $2 \times 10^6$ | 507 | 426 | 0.84 | 61 | 1.9 |
| Example 3 | 12 | $6 \times 10^6$ | 536 | 461 | 0.86 | 64 | 1.7 |
| Example 4 | 23 | $6 \times 10^8$ | 554 | 482 | 0.87 | 67 | 1.5 |
| Example 5 | 18 | $3 \times 10^6$ | 463 | 380 | 0.82 | 54 | 2.0 |
| Example 6 | 19 | $5 \times 10^6$ | 530 | 451 | 0.85 | 65 | 1.8 |
| Example 7 | 16 | $1 \times 10^6$ | 452 | 366 | 0.81 | 53 | 2.0 |
| Example 8 | 14 | $4 \times 10^6$ | 490 | 421 | 0.86 | 59 | 1.6 |
| Example 9 | 11 | $8 \times 10^6$ | 553 | 481 | 0.87 | 65 | 1.5 |
| Example 10 | 13 | $3 \times 10^7$ | 501 | 436 | 0.87 | 61 | 1.6 |
| Example 11 | 21 | $9 \times 10^6$ | 467 | 392 | 0.84 | 54 | 1.9 |
| Example 12 | 13 | $4 \times 10^7$ | 461 | 392 | 0.85 | 53 | 1.8 |
| Comparative example 1 | 7 | $9 \times 10^7$ | 601 | 529 | 0.88 | 94 | 1.1 |
| Comparative example 2 | 8 | $>10^8$ | 685 | 623 | 0.91 | 74 | 0.9 |
| Comparative example 3 | 9 | $>10^8$ | 590 | 531 | 0.90 | 68 | 0.9 |
| Comparative example 4 | 8 | $8 \times 10^6$ | 471 | 419 | 0.89 | 56 | 1.2 |
| Comparative example 5 | 6 | $2 \times 10^7$ | 432 | 384 | 0.89 | 48 | 1.0 |

The copper alloy wires according to the comparative examples had ratios of 0.2% proof stress to tensile strength that were more than 0.87, and were accordingly inferior in impact resistance. In contrast, the copper alloy wires according to the examples had ratios of 0.2% proof stress to tensile strength that were 0.87 or less, and were accordingly excellent in impact resistance.

The copper alloy wires that contained Fe of 0.4 mass % to 1.5 mass % and Ti of 0.1 mass % to 1.0 mass % could have improved strength. The copper alloy wires of which the numbers of the precipitates having a circle equivalent diameter of 10 nm to 90 nm were ten or more in the observation visual field of 700×850 nm could have improved strength while having ratios of 0.2% proof stress to tensile strength kept low, and even the small-diameter electric wires having a conductor cross-sectional area of 0.22 $mm^2$ or less could obtain required crimping strength to a terminal. The copper alloy wires having dislocation densities of $10^6$ to $10^8$ cm' could have improved strength while having ratios of 0.2% proof stress to tensile strength kept low. The copper alloy wires having high dislocation densities had reduced elongation and higher ratios of 0.2% proof stress to tensile strength, which led to low impact resistance.

While the embodiments of the present invention have been described in detail, the present invention is not limited to the above-described embodiments, and various modifications can be made without departing from the gist of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A copper alloy wire for use as a conductor, the wire having a ratio of 0.2% proof stress to tensile strength that is 0.87 or less, and comprising a copper alloy that consists of Fe, Ti, and the balance Cu with impurities, and wherein the copper alloy wire has a tensile strength of 450 MPa or more and an elongation of 8% or more, and wherein ten to twenty three $Fe_2Ti$ precipitates having a circle equivalent diameter of 10 nm to 90 nm are present in an observation visual field of 700×850 nm.

2. The copper alloy wire according claim 1, wherein the content of Fe in the copper alloy wire is 0.4 mass % to 1.5 mass %.

3. The copper alloy wire according to claim 1, wherein the content of Ti in the copper alloy wire is 0.1 mass % to 1.0 mass %.

4. The copper alloy wire according to claim 1, further comprising $Fe_2Ti$ precipitates.

5. The copper alloy wire according to claim 1, the copper alloy wire having a dislocation density in the range of $1\times10^6$ to $1\times10^8$ per $cm^2$.

6. A copper alloy twisted wire comprising a plurality of the copper alloy wires according to claim 1.

7. The copper alloy twisted wire according to claim 6, the twisted wire being compression molded in a radial direction.

8. The copper alloy twisted wire according to claim 6, the twisted wire having a cross-sectional area of 0.22 $mm^2$ or less.

9. A covered electric wire comprising a conductor comprising the copper alloy wire according to claim 1, and an insulation cover that covers an outer periphery of the conductor.

10. A wiring harness comprising the covered electric wire according to claim 9, and a terminal metal fitting that is attached to the conductor of the covered electric wire.

11. A copper alloy wire for use as a conductor, the wire having a ratio of 0.2% proof stress to tensile strength that is 0.87 or less, and comprising a copper alloy that consists of Fe, Ti, and the balance Cu with impurities, and further comprising $Fe_2Ti$ precipitates, and wherein the copper alloy wire has a tensile strength of 450 MPa or more and an elongation of 8% or more, wherein the copper alloy wire has a dislocation density in the range of $1\times10^6$ to $1\times10^8$ per $cm^2$, and wherein between ten and twenty three $Fe_2Ti$ precipitates having a circle equivalent diameter of 10 nm to 90 nm are present in an observation visual field of 700×850 nm.

* * * * *